US006575122B2

(12) United States Patent
Hipple

(10) Patent No.: US 6,575,122 B2
(45) Date of Patent: Jun. 10, 2003

(54) OSCILLATING SOOTBLOWER MECHANISM

(75) Inventor: James H. Hipple, Lancaster, OH (US)

(73) Assignee: Diamond Power International, Inc., Lancaster, OH (US)

( * ) Notice: Subject to any disclaimer, the term of this patent is extended or adjusted under 35 U.S.C. 154(b) by 0 days.

(21) Appl. No.: 10/199,626

(22) Filed: Jul. 19, 2002

(65) Prior Publication Data

US 2003/0015151 A1 Jan. 23, 2003

Related U.S. Application Data

(60) Provisional application No. 60/306,752, filed on Jul. 20, 2001.

(51) Int. Cl.[7] ..... F22B 37/54

(52) U.S. Cl. ..... 122/379; 122/390; 15/316.1

(58) Field of Search ..... 122/379, 390, 122/396, 405; 239/750, 752; 15/315, 316.1

(56) References Cited

U.S. PATENT DOCUMENTS 4,177,539 A * 12/1979 Elting ..... 15/316.1
4,229,854 A * 10/1980 Johnston, Jr. ..... 15/316.1
5,353,996 A * 10/1994 Gallacher et al. ..... 239/752
5,560,323 A * 10/1996 Billings ..... 122/379
5,619,771 A * 4/1997 Minic ..... 122/390
5,675,863 A * 10/1997 Holden et al. ..... 15/316.1

* cited by examiner

*Primary Examiner*—Gregory A. Wilson
(74) *Attorney, Agent, or Firm*—Brinks Hofer Gilson & Lione

(57) ABSTRACT

A sootblower assembly for cleaning heated surfaces within a boiler or other combustion system of the long retracting oscillation type. A kinematic drive mechanism is provided for causing the sootblower lance tube to oscillate such that cleaning medium discharge from nozzles on the lance tube emit jets of clean medium against the surfaces to be cleaned. The kinematics of the oscillation drive mechanisms are related to the lance tube nozzle positions and the distance to the surfaces being cleaned in various positions to provide a constant or nearly constant rate of sootblowing medium jet progression along the surfaces to be cleaned.

13 Claims, 5 Drawing Sheets

OSCILLATING SOOTBLOWER MECHANISM

This application claims benefit of Provisional Application No. 60/306,752 filed Jul. 20, 2001.

BACKGROUND AND SUMMARY OF THE INVENTION

This invention relates generally to a sootblower device for directing a fluid spray against a heat exchanger surface, and particularly, to such a device for providing improvements in the uniformity of the cleaning effect provided.

Cleaning highly heated surfaces, such as the heat exchange surfaces of a boiler, furnace, or the like, has commonly been performed by devices generally known as sootblowers. Sootblowers typically employ water, steam, air, or a combination thereof, as a blowing medium which is directed through one or more nozzles against encrustations of slag, ash, scale and/or other fouling materials which become deposited on the heat exchange surfaces.

Typical sootblowers of the long retracting type have a retractable lance tube which is periodically advanced into and withdrawn from the boiler and is simultaneously rotated such that one or more blowing medium nozzles at the end of the lance tube project jets tracing helical paths.

Operators of large-scale boilers are continuously striving to improve the efficiency of their operation. The fluid medium discharge by sootblowers constitutes a thermal efficiency penalty for the overall operation of the boiler system. In addition, sootblowers further require substantial quantities of superheated steam or other pressurized fluid in order to effectively operate. Therefore, operators of such devices attempt to minimize the frequency of operation of sootblowers and the quantity of fluid which they discharge during a cleaning cycle.

Most efficient cleaning operation occurs when the jet of fluid emitted from the nozzle progresses along the heat exchanger surfaces at a nearly uniform progression rate. Achieving such uniformity is difficult in situations where the distance between the sootblower nozzle and the surface being cleaned changes during the motion of the lance tube. For example, if the lance tube is rotated as it is extended and retracted from the boiler and the surfaces being cleaned are planar surfaces such as pendant wall sections of water tubes, operating the lance tube at a constant rotational speed produces significant variations in the progression rate of the cleaning medium stream as it traces its cleaning path on the surfaces. Thus, where the rate of jet progression is lowest, excessive quantities of sootblowing medium are used as compared with the amount required for effective cleaning. Moreover, physical deterioration of the heat exchanger surfaces may also occur where they are "over cleaned" in this manner. However, the cleaning requirements in areas where the jet progression rate is greatest may compel the operator to select rotation and translation speeds based on these "worst case" areas for those areas which further exacerbates the previously noted problems in the areas where jet progression is lowest.

In order to overcome the previously noted disadvantages inherent in sootblowers operating at constant rotational speeds, designers of such systems have employed various solutions. One solution involves a complex drive system for the sootblower utilizing variable speed motor controllers coupled with sensors which detect lance tube longitudinal and rotational position. An example of such a mechanism is described in U.S. Pat. No. 5,337,438 which is commonly owned by the Assignee of this application and is hereby incorporated by reference. Although highly effective, these systems impose a significant cost penalty due to the requirements of employing the previously noted controller and drive system elements. Thus, such prior art systems have cost disadvantages which may preclude their application where their capabilities may be effectively utilized. In addition to the previously noted shortcomings, such sophisticated sootblower systems pose maintenance challenges in the hostile environment in which they are employed.

Another example of oscillating type sootblower systems are provided with reference to U.S. Pat. Nos. 4,177,539 and 4,351,082, both of which are commonly assigned with application and are also hereby incorporated by reference. In accordance with the Elting U.S. Pat. No. 4,177,539 discloses an oscillating mechanism using a so-called "scotch yoke" mechanism. This system produces an oscillating angular output for the lance tube which could approach a sinusoidal angular speed variation. However, the mechanism required according to the Etling Patent is a complex mechanism requiring specialized components and modifications to existing sootblower carriage systems.

Accordingly there is a need in the art to provide a sootblower system which provides a more constant rate of jet progression without the disadvantages of sophisticated control systems as noted previously. In accordance with the present invention, a lance tube drive system is disclosed which provides a purely kinematic oscillation motion. In one embodiment, a gear reduction unit driven through a power takeoff point of the sootblower carriage is coupled through a linkage to the lance hub to provide an oscillating motion. Due to the kinematics of the drive system, this approach provides a non-uniform angular velocity which is more closely modeled as a sine wave velocity curve. This curve when coupled with the radial distance between the surface being cleaned and the lance tube nozzle can be related to provide constant or nearly constant jet progression along pendant wall sections or other planar surfaces being cleaned by the sootblower nozzle. In another embodiment, the power for the lance tube rotational drive does not come from a power take-off point of the carriage, rather power is supplied by a separate drive motor.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
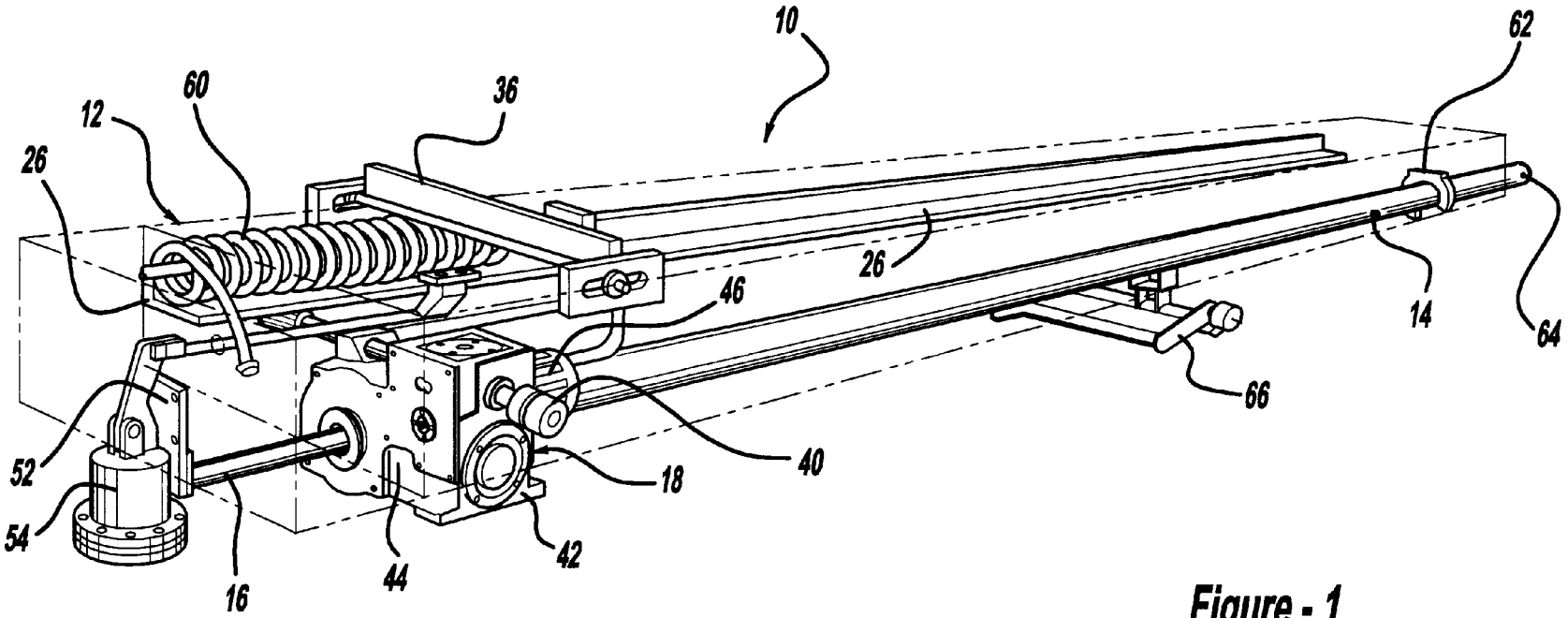
FIG. 1 is a pictorial view showing a long retracting sootblower incorporating the features of the present invention.

The sootblower assembly including the improvements of the present invention is shown in FIG. 1 and is generally designated there by reference number 10. Sootblower assembly 10 principally comprises frame assembly 12, lance tube 14, feed tube 16, and carriage 18. Sootblower 10 is shown in its normal resting or resting position. Upon actuation, lance tube 14 is extended into and retracted from a boiler (not shown) and is simultaneously oscillated rotationally.

Figure 2:
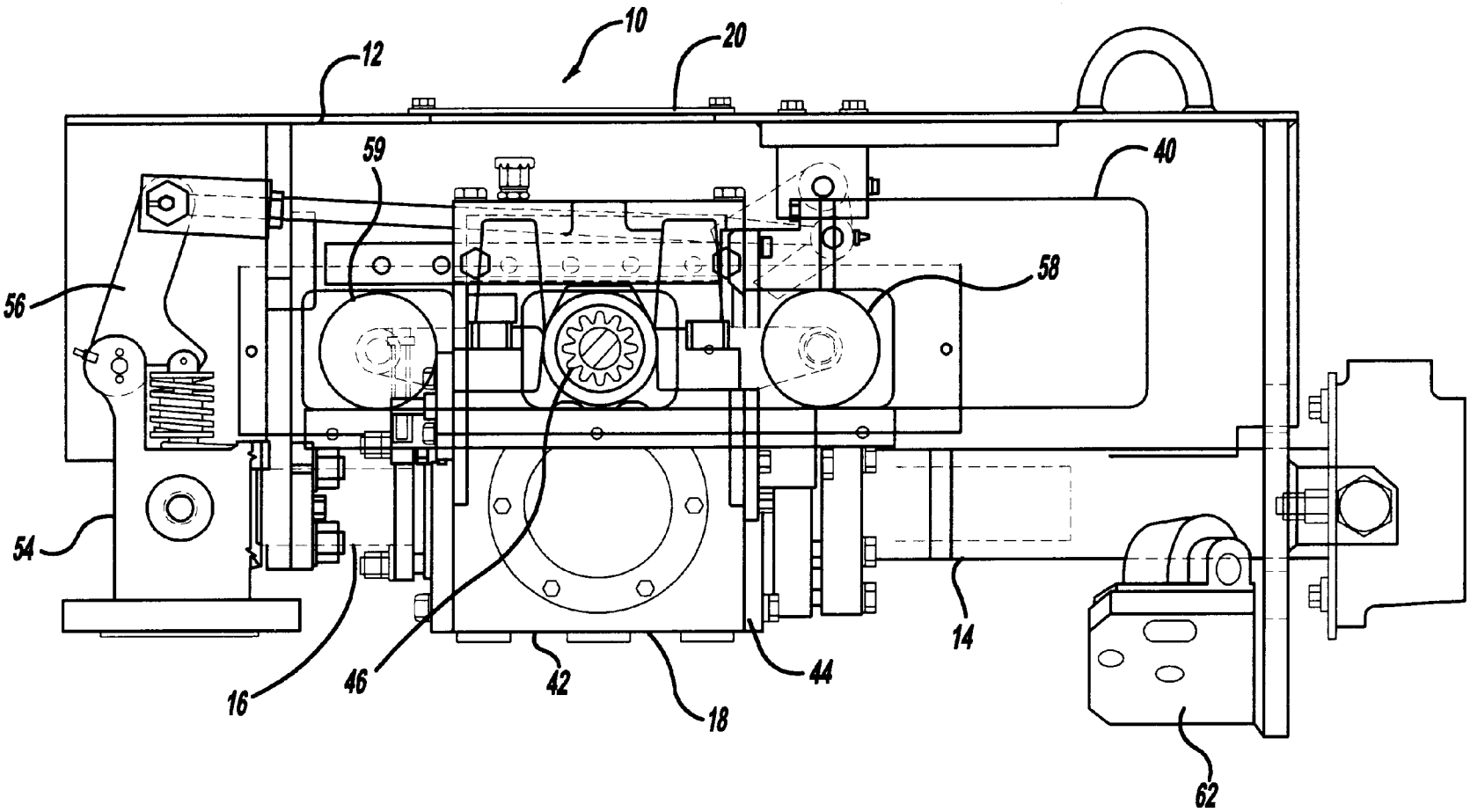
FIG. 2 is a side view (collapsed in length) of the long retracting sootblower assembly shown in FIG. 1.

As best shown in FIGS. 1 and 2, frame assembly 12 includes a generally rectangular shaped frame box 20 which forms a housing for the entire unit. Carriage 18 is guided along a pair of tracks (not shown) located on opposite sides of frame box 20. The tracks are made from angle iron stock and are connected to frame box 20 by threaded fasteners or welding. Toothed racks (not shown) are connected to a pair of upper tracks 26 and are provided to enable longitudinal movement of carriage 18. Frame assembly 12 is supported at a wall box (not shown) which is affixed to the boiler wall or another mounting structure, and is further supported by a rear support bracket 36.

Carriage 18 drives lance tube 14 into and out of the boiler and includes drive motor 40 and gear box 42 which is enclosed by housing 44. Carriage 18 drives a pair of pinion gears 46 which engage the previously mentioned toothed racks to advance carriage 18 and lance tube 14. Bearings 58 and 59 engage with tracks 26 to support carriage 18.

Feed tube 16 is attached at one end to rear bracket 52 and conducts blowing medium which is controlled through the action of poppet valve 54. Poppet valve 54 is actuated through linkages 56 which are engaged by carriage 18 to begin blowing medium (typically steam) discharge upon extension of lance tube 14, and cuts off the flow once carriage 18 returns to the idle retracted position shown in FIG. 1. Lance tube 14 over-fits feed tube 16 and a fluid seal between them is provided by packing gland (not shown) so that blowing medium conducted into lance tube 14 from feed tube 16 is discharged from one or more nozzles 64 at the distal end of lance tube 14.

Coiled electrical cable 60 conducts power for drive motor 40 as the carriage 18 moves along frame assembly 12. Front support bracket 62 includes bearings which support lance tube 14 during its longitudinal and rotational movement. For long lance tube lengths, an intermediate support 66 may be provided to prevent excessive bending deflection of the lance tube. Additional details of the construction of a well known design of the "IK" type sootblower manufactured by the Assignee is found in U.S. Pat. No. 3,439,376, which is hereby incorporated by reference.

The conventional sootblower carriage 18 as described in the previously noted U.S. Pat. No. 3,439,316 includes an internal gear drive system in which drive motor 40 drives the carriage to move longitudinally through rotation of pinion gears 46. Simultaneous with the longitudinal motion of carriage 18, an internal bevel gear drives a toothed hub of the lance tube, causing the lance tube to rotate simultaneous with its longitudinal motion. For these types of sootblowers, the lance tube undergoes full rotations during the longitudinal movement, usually at a constant angular speed. Accordingly, spray from nozzles 64 trace helical patterns as lance tube 14 advances into and is withdrawn from the boiler for cleaning. However, the carriage 18, in accordance with this invention, does not have rotational drive mechanisms within carriage 18 which cause rotation of the lance tube. Instead, that function is performed by novel elements in accordance with this invention as described hereinafter.

Carriage 18 of the conventional type manufactured by the assignee includes a shaft 86 (shown in FIG. 3) having a square drive tang configuration which extends from the rear face of carriage 18. This shaft is one of the internal shafts of the gear drive mechanism in which rotational torque from motor 40 causes rotation of pinion gears 46 to longitudinally move carriage 18. Square drive tang 86 is conventionally provided for servicing the carriage. Rotating the square drive tang 86 using a manual or power driven tool enables carriage 18 to be moved, even while electrical power is not available or upon failure of drive motor 40 or other switching and control components. However, in accordance with a first embodiment of this invention, square drive tang 86 is provided as a power take-off point used to drive externally applied elements which actuate lance tube 14 for non-linear velocity oscillating rotational movement.

Figure 3:
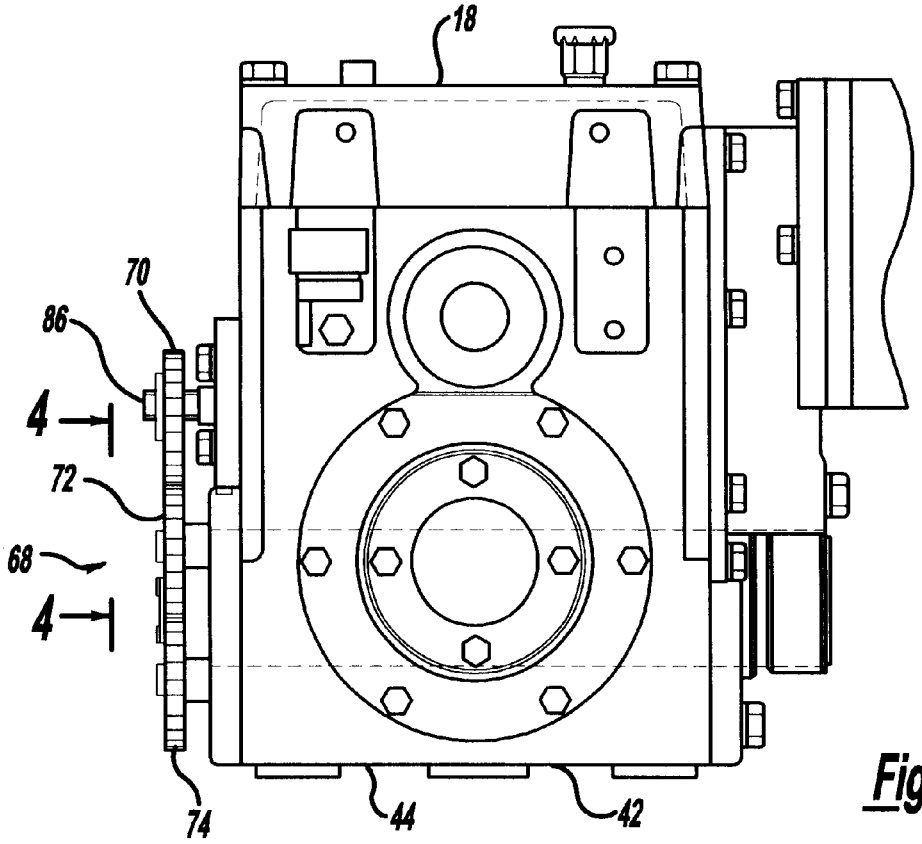
FIG. 3 is a side view of the carriage assembly illustrating a first embodiment of the invention of a lance hub oscillating drive assembly driven from a power output of the carriage.
Figure 4:
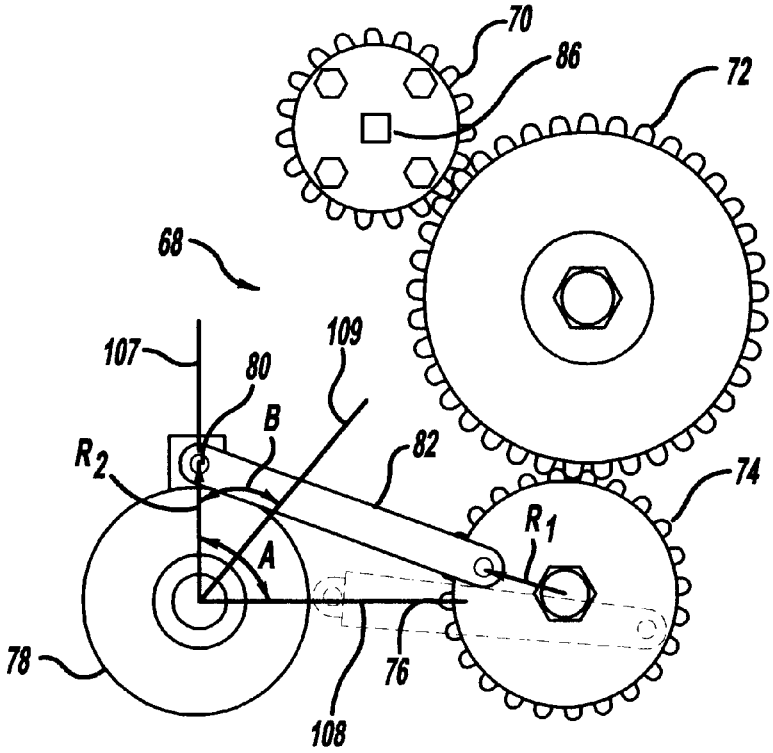
FIG. 4 is a pictorial view of the gear reduction and drive unit shown in FIG. 3.

Now with reference to FIGS. 3 and 4, an oscillation drive assembly 68 in accordance with the first embodiment of this invention is illustrated. As shown, oscillation drive assembly 68 includes drive gear 70 which is piloted onto square drive tang 86 for rotational movement therewith. Drive gear 70 meshes with reduction gear 72 which in turn meshes with crank gear 74. Crank gear 74 features a protruding pin 76. Lance hub 78 includes protruding drive pin 80. Connecting rod 82 is journalled for rotation onto pins 76 and 80. The radial distance between the center of rotation of crank gear 74 and pin 76, designated as $R_1$, is selected to be less than the radial distance between the center of rotation of lance tube hub 78 and drive pin 80, designated as $R_2$. This relationship is significant since rotation of drive gear 70 in turn causes complete rotations of crank gear 74. As pin 76 undergoes its orbital motion it is desired to cause lance tube 14 to undergo oscillatory motion. In order to have control over the rotational movement of lance tube 14 it is important that the position of drive pin 80 does not achieve an "over center" condition in which a line drawn longitudinally through the connecting rod 82 would intersect the center of rotation of the lance tube.

Rotation of drive gear 70 causes oscillatory movement of lance hub 78 from the position shown in FIG. 4. As will be described in more detail below, the rotational speed of lance hub 78 undergoing its oscillating motion is nonlinear. This is a desirable characteristic since it can be related to lance tube nozzle position with respect to surfaces being cleaned.

Figure 5:
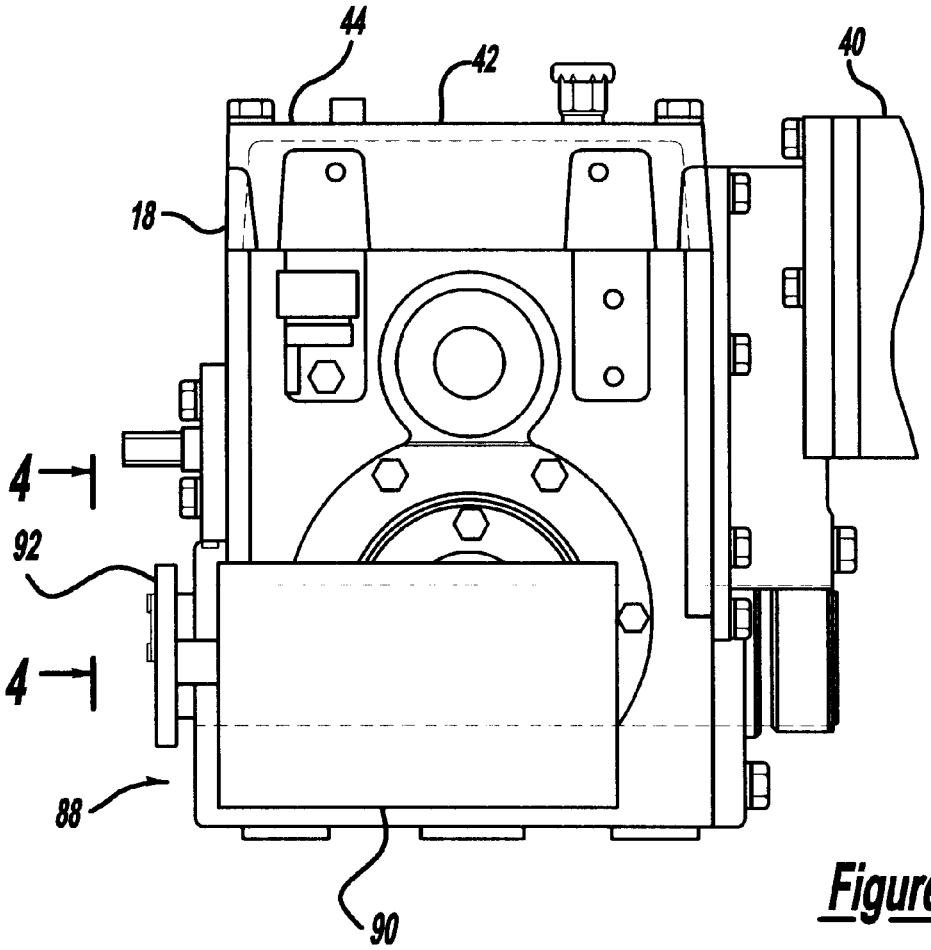
FIG. 5 is a side view of a carriage in accordance with the second embodiment of this invention in which the lance hub oscillating drive assembly is powered by a separate motor.
Figure 6:
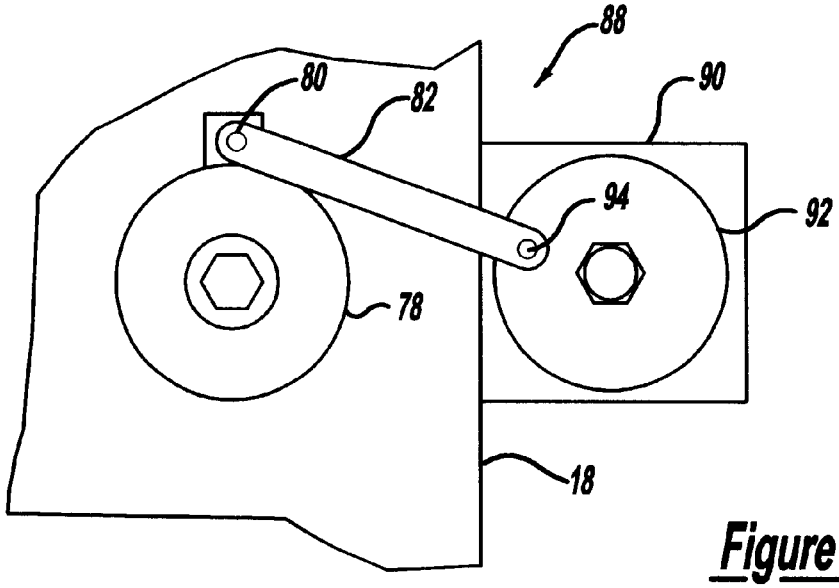
FIG. 6 is a simplified pictorial view of the lance drive system shown in FIG. 5.

Oscillation drive assembly 88 in accordance with the second embodiment of this invention is illustrated with reference to FIGS. 5 and 6. This embodiment differs from the prior embodiment 68 in that power to drive the oscillation drive assembly 88 does not come from square drive tang 86, but rather through an externally mounted oscillation drive motor 90. Motor 90 may also incorporate an internal gear reduction unit which causes lance hub 78 to oscillate at a desired speed. As in the prior embodiment, the connecting rod 82 drives lance hub 78 at projecting drive pin 80. The relationships of the drive radii are the same as described previously in that the over-center condition is to be avoided and thus the maximum range of angular travel of lance hub 78 is limited to less than 180 degrees.

Oscillation drive assembly 68 described above provides a positive geared relationship between oscillation movement and lance tube longitudinal movement. This relationship is defined by the internal gear train relationships within carriage 18 and the drive train of oscillation drive assembly 68. By contrast, oscillation drive assembly 88 provides for independent control over the periodic oscillation rate of the lance tube hub 78 and the carriage 18 longitudinal motion and position. This independent control may be advantageous for certain applications of sootblower assembly 10. For example, there are applications in which a degree of randomness is desired in the relationship between lance rotated and longitudinal positions as occurring in successive operating cycles.

A principal feature of both oscillation drive assembly 68 and 88 is their ability to be adapted to existing designs of sootblower carriage 18. Modifications required would include disabling the internal connection with the lance tube for rotation and mounting one of the oscillation drive assemblies to the carriage 18 in accordance with this invention. This configuration allows convenient retrofitting of sootblower assemblies to provide oscillation movement without significant reworking of existing available components.

Now with reference to FIG. 7 the operation of sootblower assembly 10 will be described in connection with a typical boiler configuration as lance tube 14 is being inserted into boiler 96 along an axis which would extend out of the plane of the drawing. Vertical heated surfaces such as divider walls, wing walls, or pendant sections 98 extend generally parallel to one another at a space distance from the lance tube insertion axes 100. As lance tubes 14 are inserted and oscillated the point of impingement of the jet of sootblowing medium being discharged from nozzle 64 will travel up and down along the surface of one wing wall 98 and then along the surface of an immediately adjacent wing wall 98.

Figure 7:
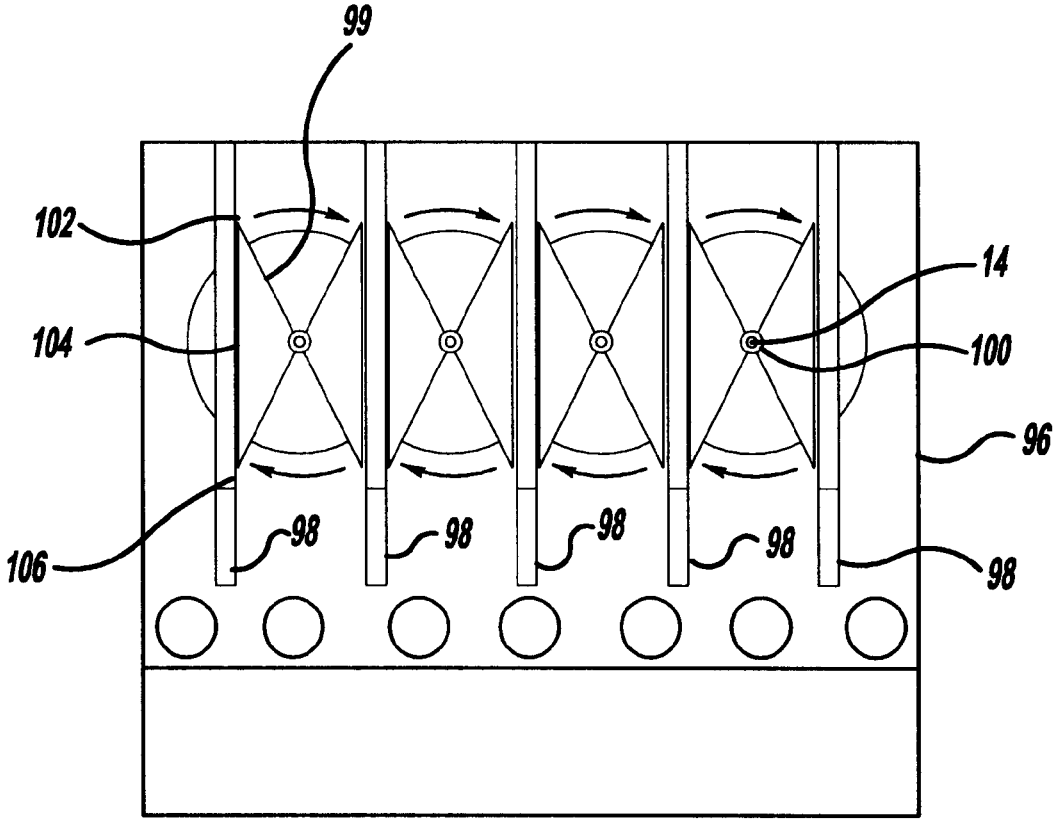
FIG. 7 is a diagrammatic front elevational view illustrating operation of an oscillating sootblower in a boiler interior.

As is readily apparent from FIG. 7, from the point of initial impingement, designated at 102, as a jet 99 travels up or down walls 98, the distance from the nozzle 64 to the point of impingement against the walls 98 decreases until the jet 99 is being projected substantially perpendicular to wing wall 98 at point 104. Thereafter, upon continued angular displacement of lance tube 14, to point 106, this distance increases as the jet 99 continues to progress down the wall 98. It follows that for a constant rate of rotation of lance tube 14, the rate of linear travel of the point of impingement of the jet 99 along the surface of the wall 98 will be much slower in those areas which are substantially horizontal with the lance tube 14 (e.g., at point 104) and much faster in those areas near the initial and final impingement areas (e.g., at points 102 and 106) resulting in uneven cleaning. The oscillation drive assemblies 68 and 80 in accordance with this invention provide a non-linear rate of oscillation movement. By relating the kinematics of the oscillation drive mechanisms 68 and 88, a nearly constant rate of jet progression can be provided.

Now again with reference to FIGS. 4 and 7, lance hub 78 is shown oscillating between positions designated by ray 107 to the opposite extreme position designated by ray 108. This is caused by complete rotations of crank gear 74 as previously explained. Drive assembly 68 would be phased such that the positions of lance hub 78 corresponding with the rotational positions designated by rays 107 and 108 which correspond with the positions of lance tube nozzles 64 causing impingement at points 102 and 106 in FIG. 7 (where the spray from the nozzles travels the longest distance). Ray 109 designates an angular bisector between the angular positions of 107 and 108 and corresponds with impingement of a jet from nozzle 64 at point 104. It can be shown by simple kinematics calculations that the rate of angular rotation of lance hub 78 is at maximum when it is at the position designated at ray 109 (where the spray from the nozzles travel the shortest distance impacting at point 104) and decreases to the end point positions designated by rays 107 and 108 causing jet imparts at points 102 and 106. As stated previously, this corresponds with a desired increase in rotational rate when the jets impact point 104 and a decrease in jet progression rate as the jets reach the positions designated by points 104 and 106. While the drive system of oscillating drive assembly 68 may not provide a truly uniform rate of jet progression along walls 98 (i.e. the rate at which the impact area of spray from the nozzles moves along the surfaces), the rate is modulated to be an improvement over the constant rotational rate typically provided. The oscillating drive assembly 88, in accordance with a second embodiment of this invention, would be phased in precisely the same manner as that described in connection with drive assembly 68. Thus, the position of the components illustrated in FIG. 6 would correspond with the nozzle 64 impacting one of its extreme positions designated by points 102 or 106 shown in FIG. 7.

It is to be understood that the invention is not limited to the exact construction illustrated and described above, but that various changes and modifications may be made without departing from the spirit and scope of the invention as defined in the following claims.

I claim:

1. An oscillation drive assembly for a sootblower for cleaning internal surfaces of a combustion device, of the type having a frame assembly, a lance tube having one or more nozzles for directing a jet of fluid cleaning medium against the internal surfaces of the combustion device to be cleaned, the lance tube mounted to a carriage movable along the frame assembly for extending the lance tube into and retracting the lance tube from the interior of the combustion device, the oscillation drive assembly comprising:

a lance hub coupled to the lance tube, and the lance tube and the lance hub being rotatable about a first axis of rotation;

a first drive pin coupled to the lance tube hub and displaced from the first axis;

a drive gear rotatable about a second axis of rotation and having a second drive pin displaced from the second axis;

a drive train causing the drive gear to undergo rotational movement; and a connecting rod coupled to both the first and the second drive pins whereby rotation of the drive gear drives, the lance tube hub, and the lance tube for rotational oscillation movement in a manner which produces a non-uniform rate of rotational movement of the lance tube and wherein the angular position of the lance tube nozzles relative to the internal surfaces of the combustion device is phased with the non-uniform rate of rotation to provide a desired rate of progression of the jet of blowing medium along the surfaces to be cleaned.

2. The oscillation drive assembly of claim 1, wherein a first drive radius defined by the radial distance between the first drive pin and the first axis of rotation is greater than a second drive radius defined by the radial distance between the second drive pin and the second axis of rotation.

3. The oscillation drive assembly of claim 1, wherein the drive train is driven by the carriage.

4. The oscillation drive assembly of claim 1, wherein the drive train is driven by a motor mounted to the carriage.

5. The oscillation drive assembly of claim 1, wherein the drive train is driven by a motor mounted to the carriage and wherein the rate of longitudinal movement of the carriage and the oscillation of the lance tube are independently controllable.

6. The oscillation drive assembly of claim 1, wherein the rate of rotations of the lance tube is related to the positions of the nozzle and the surfaces to be cleaned to provide a constant rate of progression of the jet along the surfaces to be cleaned.

7. The oscillation drive assembly of claim 1, wherein the jet from the lance tube nozzle travels a first distance to impact the surfaces to be cleaned when the lance tube is at a first angular position, and the jet from the lance tube nozzle travels a second distance to impact the surfaces to be cleaned when the lance tube is at a second angular position and wherein the first distance is less the than the second distance and the oscillation drive assembly is phased such that the angular rate of rotation of the lance tube at the first angular position is greater than the angular rate of rotation of the lance tube at the second angular position.

8. An oscillation drive assembly for a sootblower for cleaning internal surfaces of a combustion device, of the type having a frame assembly, a lance tube having at least one nozzle for directing a jet of fluid cleaning medium against the internal surfaces of the combustion device to be cleaned such that the spray from the nozzle travels a first distance when the lance tube is at a first angular position and the jet from the nozzle travels a second distance when the lance tube is at a second angular position and wherein the first distance is less than the second distance, the lance tube mounted to a carriage movable along the frame assembly for extending the lance tube into and retracting the lance tube from the interior of the combustion device, the oscillation drive assembly comprising:

a lance hub coupled to the lance tube, and the lance and the lance hub being rotatable about a first axis of rotation;

a first drive pin coupled to the lance tube hub and displaced from the first axis;

a drive gear rotatable about a second axis of rotation and having a second drive pin displaced from the second axis;

a drive train causing the drive gear to undergo rotational movement; and a connecting rod coupled to both the first and second drive pins whereby rotation of the drive gear drives the lance tube hub and the lance tube for rotational oscillation movement in a manner which produces a non-uniform rate of rotational movement of the lance tube and wherein the angular position of the lance tube nozzles relative to the internal surfaces of the combustion device is phased with the non-uniform rate of rotation to provide a higher rate of progression of the jet of blowing medium when the lance is at the first angular position and a slower rate of progression of the jet when the lance is at the second angular position.

9. The oscillation drive assembly of claim 8, wherein a first drive radius defined by the radial distance between the first drive pin and the first axis of rotation is greater than a second drive radius defined by its radial distance between the second drive pin and the second axis of rotation.

10. The oscillation drive assembly of claim 8, wherein the drive train is driven by the carriage.

11. The oscillation drive assembly of claim 8, wherein the drive train is driven by a motor mounted to the carriage.

12. The oscillation drive assembly of claim 8, wherein the drive train is driven by a motor mounted to the carriage and wherein the rate of longitudinal movement of the carriage and the oscillation of the lance tube are independently controllable.

13. The oscillation drive assembly of claim 8, wherein the rate of rotations of the lance tube is related to the positions of the nozzle and the surfaces to be cleaned to provide a constant rate of progression of the jet along the surfaces to be cleaned.

* * * * *